US005595552A

United States Patent [19]

Wright et al.

[11] Patent Number: 5,595,552

[45] Date of Patent: Jan. 21, 1997

[54] GOLF CLUB HEAD WITH TUNING AND VIBRATION CONTROL MEANS

[75] Inventors: David E. Wright, Glendale; John A. Solheim; Daniel J. Kubica, both of Phoenix, all of Ariz.

[73] Assignee: Karsten Manufacturing Corp., Phoenix, Ariz.

[21] Appl. No.: 573,525

[22] Filed: Dec. 15, 1995

[51] Int. Cl.[6] ..... A63B 53/04

[52] U.S. Cl. ..... 473/332; 473/350

[58] Field of Search ..... 473/332, 324, 473/341, 349, 350; D21/214, 220; 273/167 R

[56] References Cited

U.S. PATENT DOCUMENTS

| | | | |
|---|---|---|---|
| D. 240,841 | 8/1976 | Solheim . | |
| D. 256,264 | 8/1980 | Solheim | D21/220 |
| D. 318,703 | 7/1991 | Shearer | D21/214 |
| D. 330,577 | 10/1992 | Solheim | D21/214 |
| D. 332,812 | 1/1993 | Solheim | D21/220 |
| D. 344,778 | 3/1994 | Solheim | D21/220 |
| D. 357,293 | 4/1995 | Solheim | D21/220 |
| D. 357,294 | 4/1995 | Solheim | D21/220 |
| 2,087,685 | 7/1937 | Hackney | 273/77 |
| 2,460,435 | 2/1949 | Schaffer | 473/332 |
| 4,213,613 | 7/1980 | Nygren | 473/332 |
| 4,512,577 | 4/1985 | Solheim | 273/77 |
| 4,621,813 | 11/1986 | Solheim | 273/77 |
| 4,826,172 | 5/1989 | Antonius | 273/169 |
| 4,919,430 | 4/1990 | Antonius | 273/169 |
| 5,067,715 | 11/1991 | Schmidt et al. | 473/332 |
| 5,193,805 | 3/1993 | Solheim | 273/77 |

*Primary Examiner*—Mark S. Graham

*Attorney, Agent, or Firm*—Darrell F. Marquette; Herbert E. Haynes, Jr.

[57] ABSTRACT

A golf club head includes a heel end, a toe end, a front face arranged to impact a golf ball, and a back face disposed rearwardly of the front face. A perimeter weighting element protrudes rearwardly away from the front face and defines a cavity in the back face. The perimeter weighting element includes a top rail and a sole. A plurality of ribs are disposed in the cavity for eliminating undesirable vibrations in the golf club head when the front face impacts a golf ball and for attenuating other vibrations in the golf club head. Each of the ribs extends generally radially relative to the cavity from an inner end to an outer end that merges with the perimeter weighting element. An elliptically shaped geometric region is formed in a bottom surface of the cavity for assisting the plurality of ribs in eliminating the undesirable vibrations and in attenuating the other vibrations.

16 Claims, 7 Drawing Sheets

GOLF CLUB HEAD WITH TUNING AND VIBRATION CONTROL MEANS

BACKGROUND OF THE INVENTION

This invention relates generally to golf equipment and, in particular, to a golf club head with tuning and vibration control means.

U.S. Pat. No. 5,193,805 to Karsten Solheim discloses a golf club head which is an improvement over prior golf club heads such as disclosed in U.S. Pat. Nos. 4,512,577 and 4,621,813 to Karsten Solheim. The club head disclosed in the Solheim U.S. Pat. No. 5,193,805 patent includes a top rail, a sole, upper heel and toe protuberances adjacent opposite ends of the top rail, and lower heel and toe mass concentrations adjacent opposite ends of the sole. The upper heel and toe protuberances cause the club head to resist tilting movement about a generally horizontal axis, and a notch formed in a trailing edge of the sole increases the relative sizes of the lower heel and toe mass concentrations thus increasing the club head resistance to twisting movement about a generally vertical axis. While the disclosed club heads perform satisfactorily, it is recognized that further improvements are possible.

SUMMARY OF THE INVENTION

One further improvement is to provide a club head with means for tuning the club head and for controlling vibration in the club head by eliminating undesirable vibrations caused when the club head impacts a golf ball and by attenuating other vibrations in the club head. When a golfer uses a golf club equipped with a tuned and vibration controlled club head, the sound and feel of the club head impacting a golf ball will be more desirable.

The present invention provides a golf club head comprising a body having a heel end, a toe end, a front face arranged for impact with a golf ball, a back face disposed rearwardly of the front face, and a perimeter weighting element protruding rearwardly away from the front face defining a cavity in the back face. The perimeter weighting element includes a top rail and a sole. The top rail extends between the body heel and toe ends along an upper portion of the body, and the sole extends between the body heel and toe ends along a lower portion of the body. A plurality of ribs are disposed in the cavity for eliminating undesirable vibrations in the golf club head caused when the front face impacts a golf ball and for dampening other vibrations in the golf club head. Each of the ribs has an outer end that merges with the perimeter weighting element. A geometric region is formed in a bottom surface of the cavity for assisting said plurality of ribs in eliminating the undesirable vibrations and in attenuating the other vibrations.

In the preferred embodiment of the club head, each rib extends generally radially from an inner end to its outer end, and the plurality of ribs includes five ribs. One of the ribs extends toward the toe end of the body, two of the ribs extend toward the top rail, and two of the ribs extend toward the sole. The body has a center of gravity located within the geometric region, and a ring is formed integrally with and rises above the geometric region. A projection is also formed integrally with and rises above the geometric region. The ring encircles the center of gravity of the body and the projection. The plurality of ribs, the geometric region, the ring, and the projection comprise means for tuning the club head and for controlling vibration in the club head in order to improve the sound and feel of the club head impacting a golf ball.

DESCRIPTION OF THE PREFERRED EMBODIMENT

Figure 1:
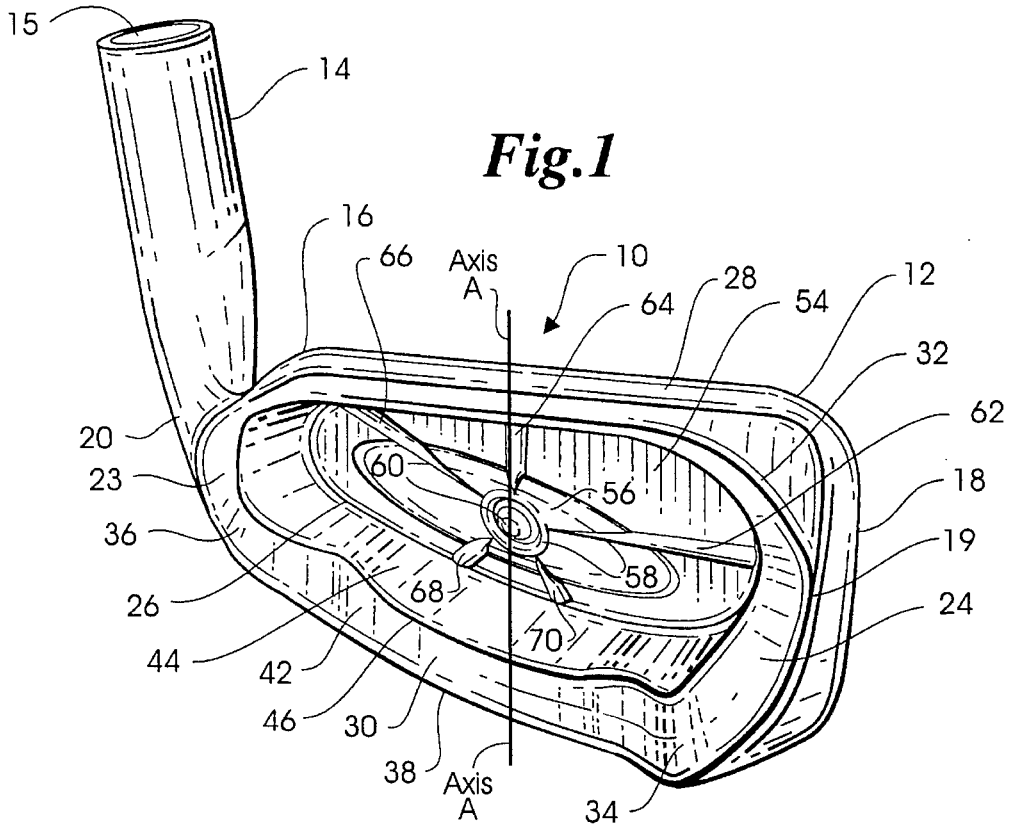
FIG. 1 is a perspective view of a golf club head according to the preferred embodiment of the present invention.
Figure 2:
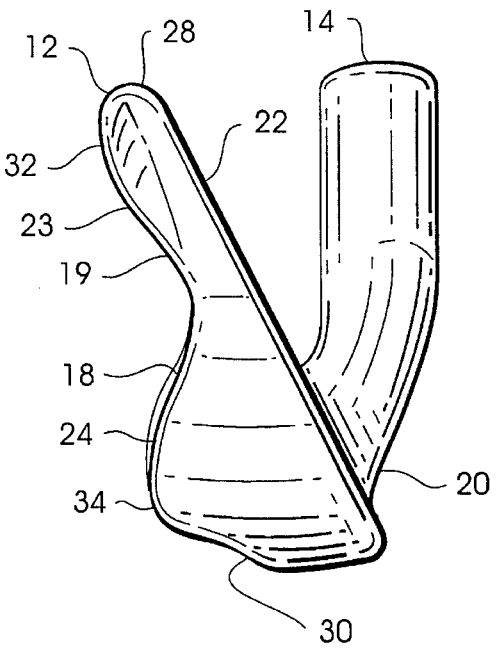
FIG. 2 is a toe end view of the golf club head of FIG. 1.
Figure 3:
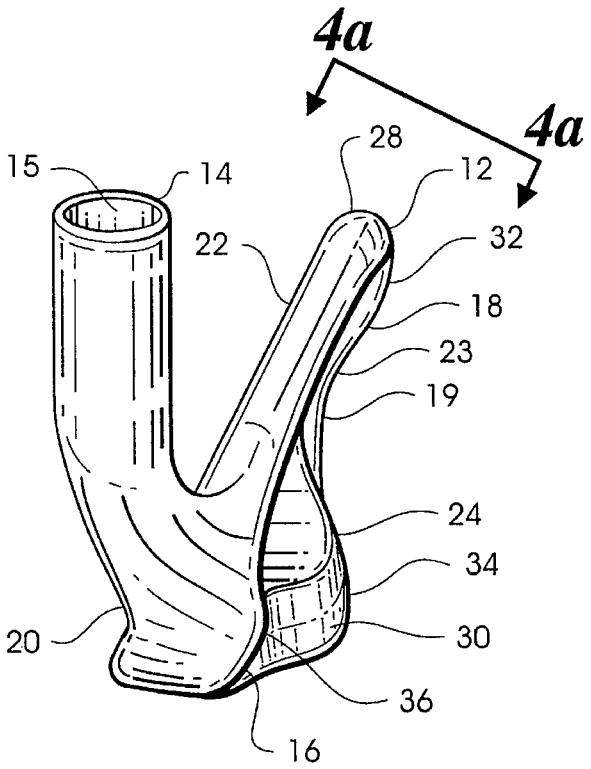
FIG. 3 is a heel end view of the golf club head of FIG. 1.

Referring to FIGS. 1–7, a golf club head 10 according to the preferred embodiment of the present invention includes a body 12 and a hosel 14 with a cylindrical bore 15 for receiving a golf club shaft (not shown). Although the club head 10 is shown as a five-iron, it could be any iron-type club head from a one-iron to a wedge. The body 12 has a heel end 16 and a toe end 18 that are spaced apart. The hosel 14 is adjacent the heel end 16 of the body 12 and includes a neck 20 which has a reduced thickness as described in U.S. Pat. No. 4,512,577 to Karsten Solheim. The body 12 and the hosel 14 are preferably cast from suitable metal such as beryllium copper or stainless steel. A front face 22 arranged for impact with a golf ball (not shown) is provided on the body 12 and extends between the body heel and toe ends 16, 18 along a frontal portion of the body 12. Disposed rearwardly of the front face 22 is a back face 23.

A perimeter weighting element 24 protrudes rearwardly away from the front face 22 and defines a cavity 26 in the back face 23. The perimeter weighting member 24 includes a top rail 28 and a sole 30. The cavity 26 is defined at its upper extremity by the top rail 28 and at its lower extremity by the sole 30. The top rail 28 extends between the body heel and toe ends 16, 18 along an upper portion of the body 12, and the sole 30 extends between the body heel and toe ends 16, 18 along a lower portion of the body 12. The perimeter weighting element 24 also includes an upper toe weight 32 adjacent a toe end of the top rail 28, a lower toe weight 34 adjacent a toe end of the sole 30, and a lower heel weight 36 adjacent a heel end of the sole 30. The toe end 18 of the body 12 has a back edge 19 that is indented toward the front face 22 between the top rail 28 and the sole 30 separating the upper toe weight 32 from the lower toe weight 34.

The upper and lower toe weights 32, 34 and the lower heel weight 36 provide the club head 10 with resistance to twisting movement about a vertical axis A through the body 12 as a result of the front face 22 impacting a golf ball near the heel end 16 or the toe end 18 of the body 12. The sole 30 has a lower trailing edge 38 that includes an indentation 40 between the lower heel and toe weights 34, 36 as described in U.S. Pat. No. 4,621,813 to Karsten Solhelm. Located adjacent the lower trailing edge 38 of the sole 30 is a lower backsurface 42 of the perimeter weighting element 24. This lower backsurface 42 preferably slopes upwardly and inwardly from the trailing edge 38 toward the front face 22. The lower backsurface 42 merges with a lower innersurface 44 of the perimeter weighting element 24 along an upper trailing edge 46 of the sole 30. The indentation 40 and the sloping orientation of the lower backsurface 42 serve to redistribute material in the body 12 in a manner that increases the relative sizes of the lower heel and toe weights 34, 36 thereby increasing the resistance of the club head 10 to the above-mentioned twisting movement.

Figure 4:
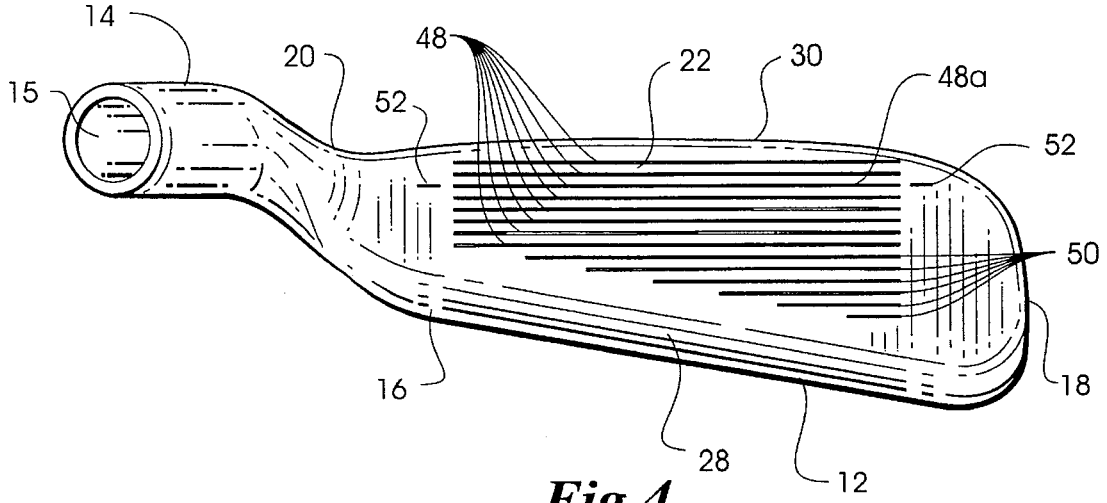
FIG. 4 is a top view of the golf club head of FIG. 1.
Figure 4A:
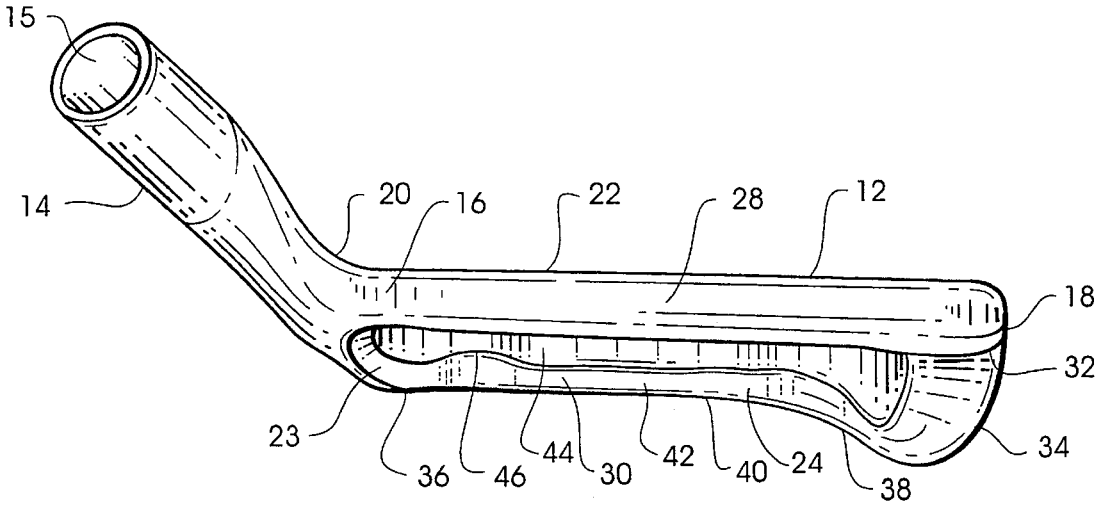
FIG. 4*a* is a view of the golf club head of FIG. 1 taken along lines 4—4 in FIG. 3.
Figure 5:
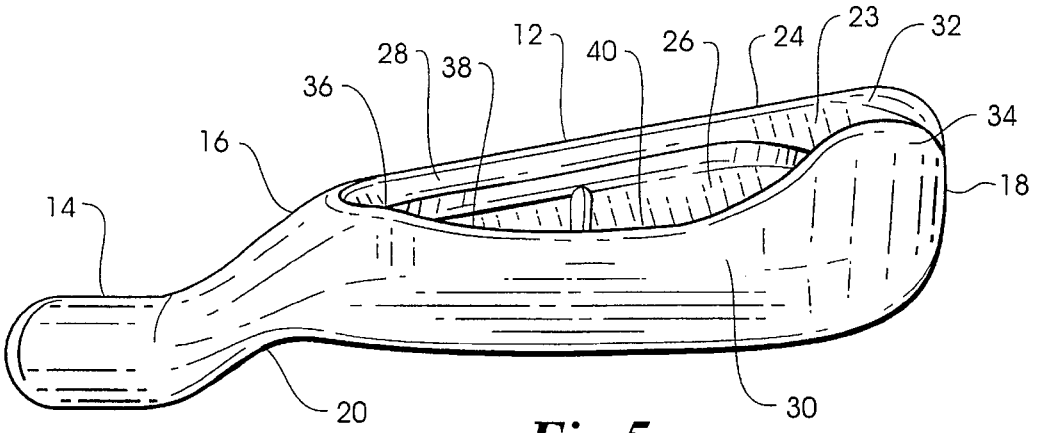
FIG. 5 is a bottom view of the golf club head of FIG. 1.
Figure 6:
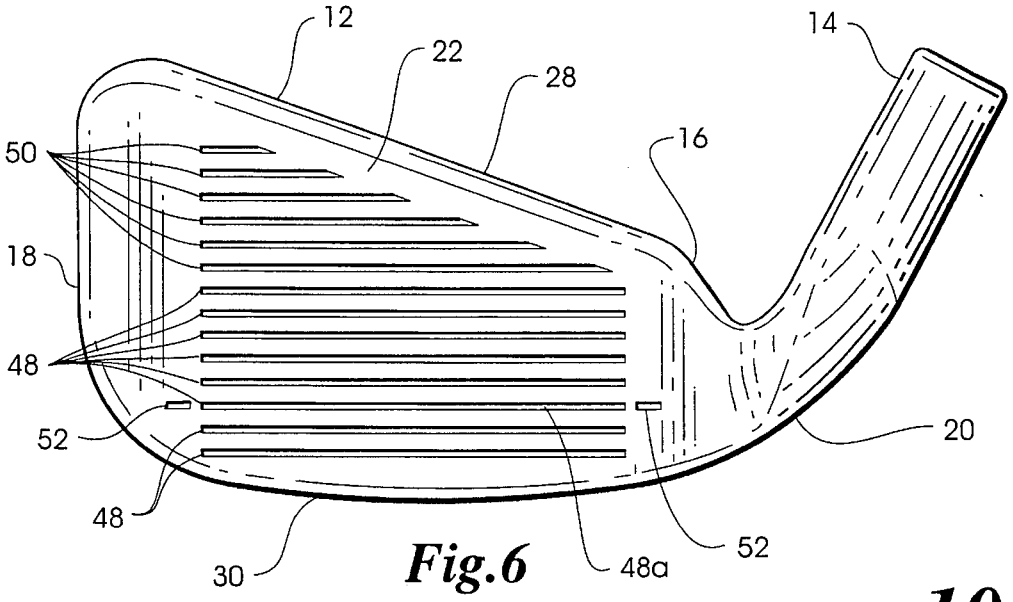
FIG. 6 is a front elevational view of the golf club head of FIG. 1.
Figure 7:
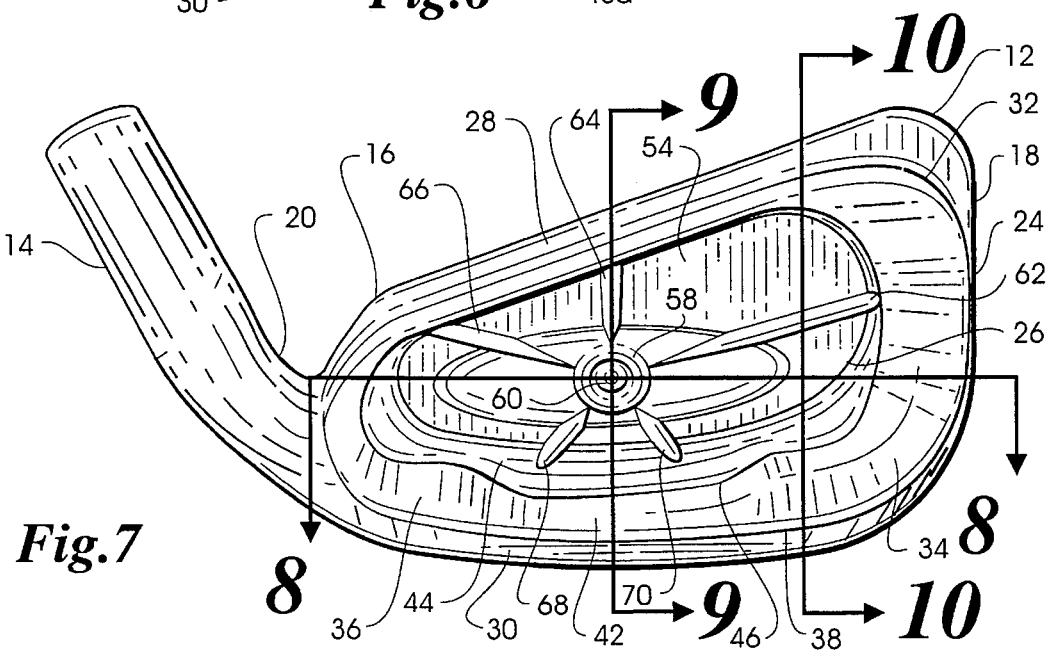
FIG. 7 is a rear elevational view of the golf club head of FIG. 1.
Figure 8:
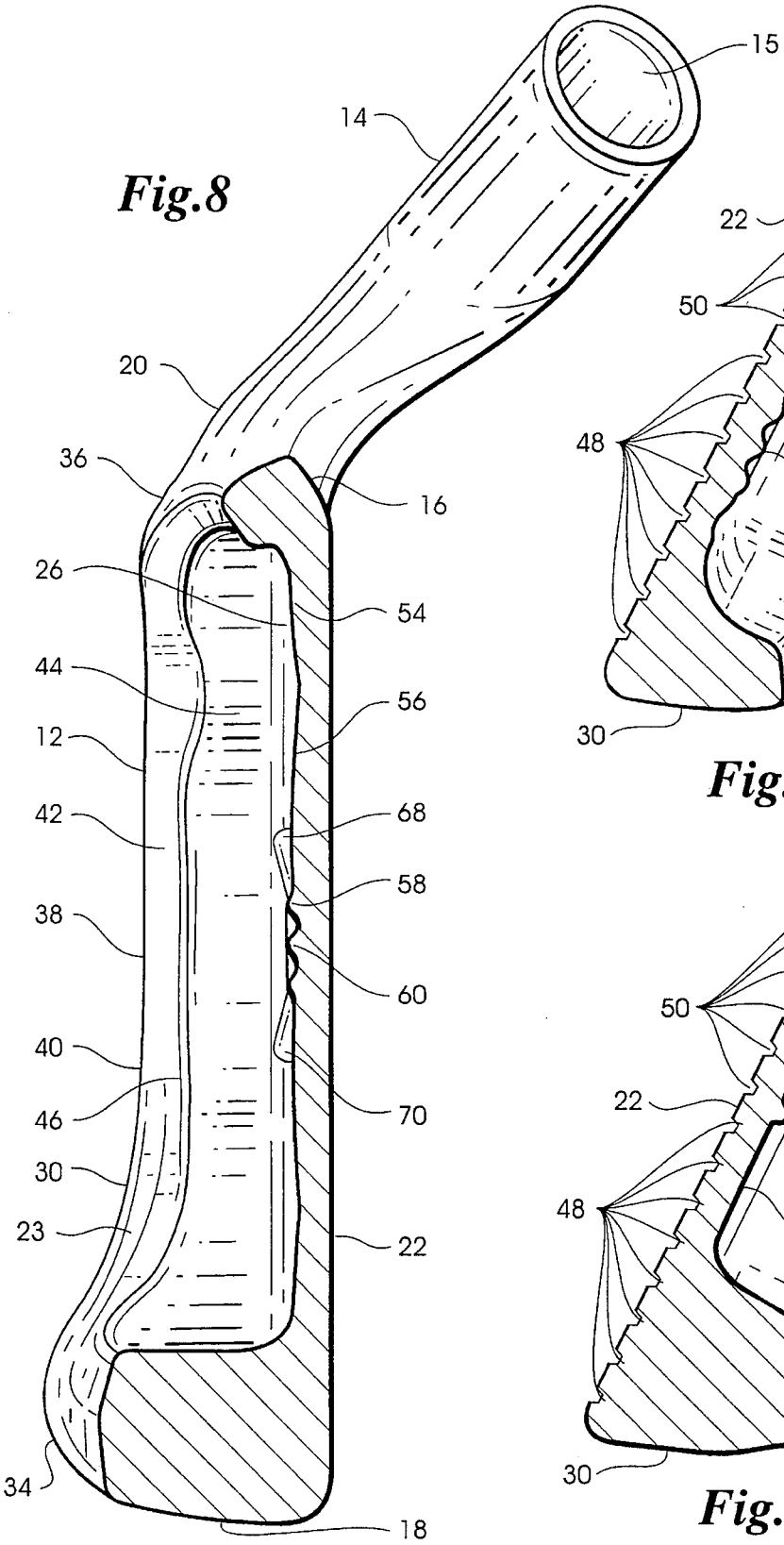
FIG. 8 is an enlarged cross-sectional view taken along lines 8—8 in FIG. 7.
Figure 9:
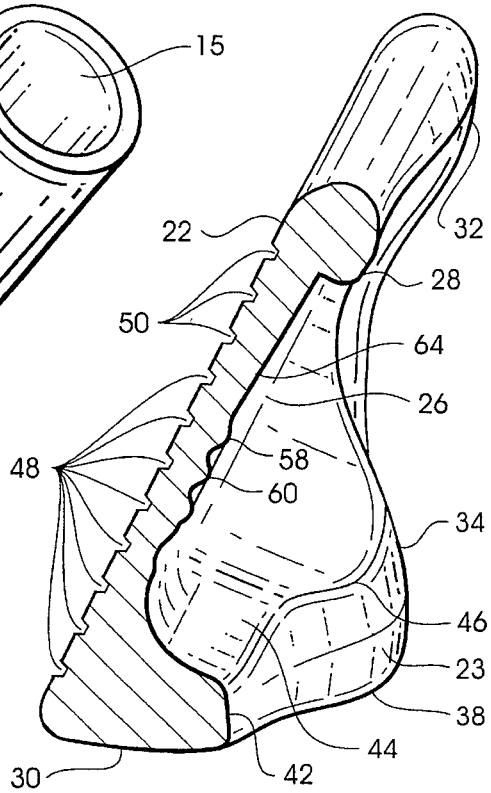
FIG. 9 is an enlarged cross-sectional view taken along lines 9—9 in FIG. 7.

As seen in FIGS. 4 and 6, the front face 22 of the body 12 has a plurality of eight grooves 48 of equal length and a plurality of six grooves 50 of varying length formed therein. A pair of shortened grooves 52 (approximately ⅛ inch long) are provided in the front face 22 adjacent opposite ends of the groove that is designated 48*a*. These shortened grooves 52 serve as visual indicators preferably aligned with the groove 48*a* and preferably filled with a contrasting color of paint so that they are highly visible. When the club head 10 is placed at "address" behind a golf ball, the grooves or visual indicators 52 are utilized by a golfer in a manner to position the club head 10 so that the grooves 48 and 50 lie perpendicular (i.e. square) to an intended target line. If the visual indicators 52 are utilized in this manner, the club head 10 will not be inadvertently positioned with the front face 22 "open" or "closed".

It will be understood that the visual indicators 52 must be aligned with the opposite ends of the same groove 48 or 50 in order for the club head 10 to be properly positioned at "address". In club heads such as a wedge (not shown) where the front face 22 is disposed at a higher loft angle than in the club head 10, the visual indicators 52 would be aligned with a groove that is below the groove 48*a* in order to be more visible. In club heads such as a one-iron (not shown) where the front face 22 is disposed at a lower loft angle than in the club head 10, the visual indicators 52 would be aligned with a groove that is above the groove 48*a* so that they are more visible.

Figure 10:
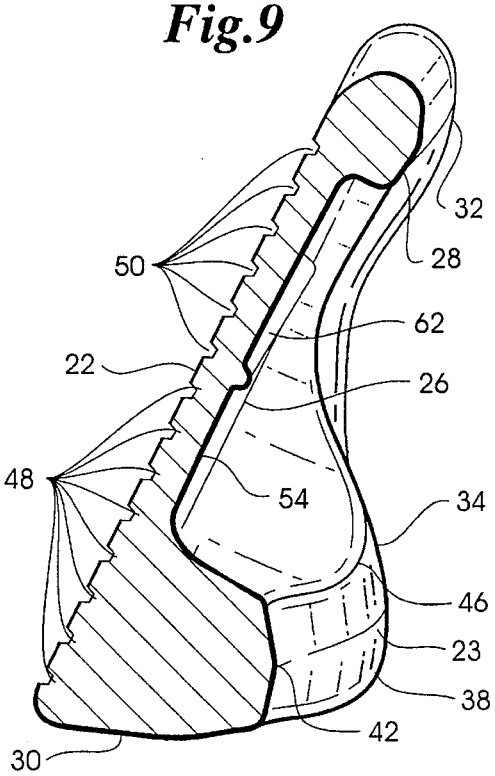
FIG. 10 is an enlarged cross-sectional view taken along lines 10—10 in FIG. 7.
Figure 11:
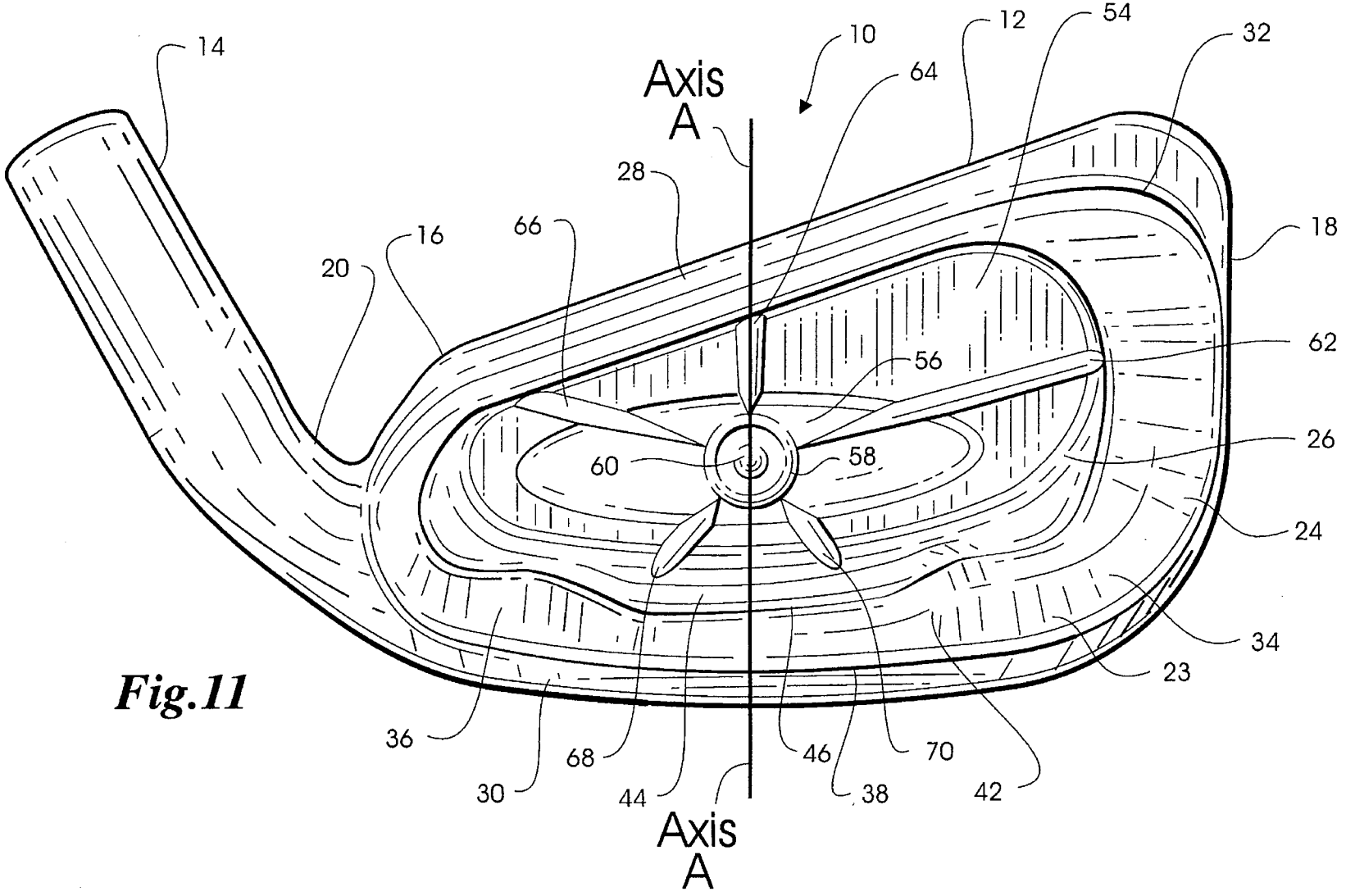
FIG. 11 is an enlarged rear elevational view of the golf club head of FIG. 1.

Referring to FIG. 11, the cavity 26 defined by the perimeter weighting element 24 has a bottom surface 54. Formed in the bottom surface 54 is an elliptically shaped geometric region 56, and formed integrally with and rising above the region 56 are a ring 58 and a projection 60. The ring 58 encircles the center of gravity of the club head 10 and the projection 60. Disposed in the cavity 26 is a plurality of five ribs 62, 64, 66, 68 and 70. Each of the ribs 62–70 extends generally radially relative to the cavity 26 from an inner end proximate the ring 58 to an outer end that merges with the perimeter weighting element 24. The rib 62 extends toward the toe end 18 of the body 12. The ribs 64 and 66 extend toward the top rail 28, and the ribs 68 and 70 extend toward the sole 30. As shown in FIG. 10, the ribs 62–70 each have an arch shaped cross-section.

Figure 12:
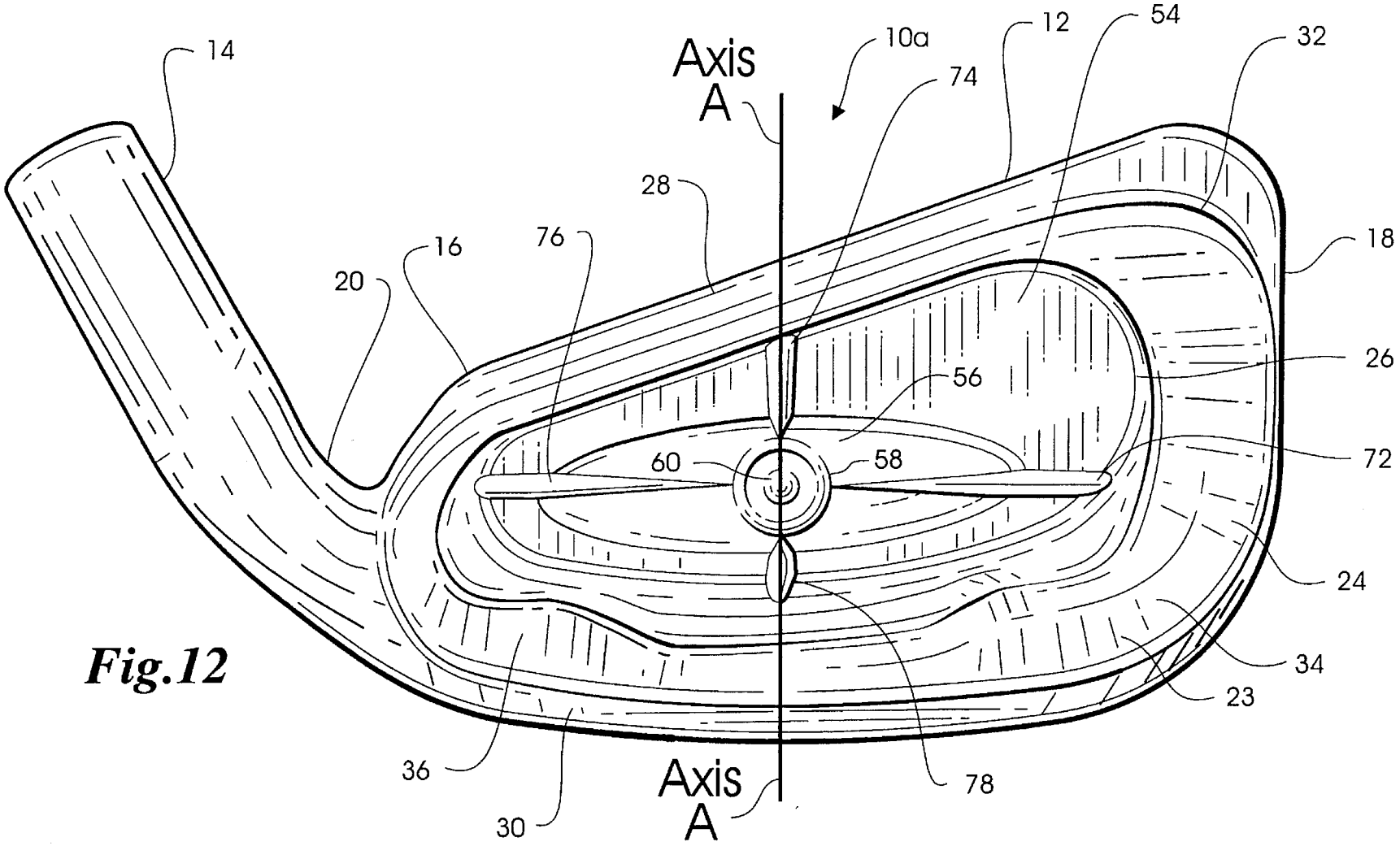
FIGS. 12 and 13 are enlarged rear elevational views of golf club heads according to alternative embodiments of the present invention.
Figure 13:
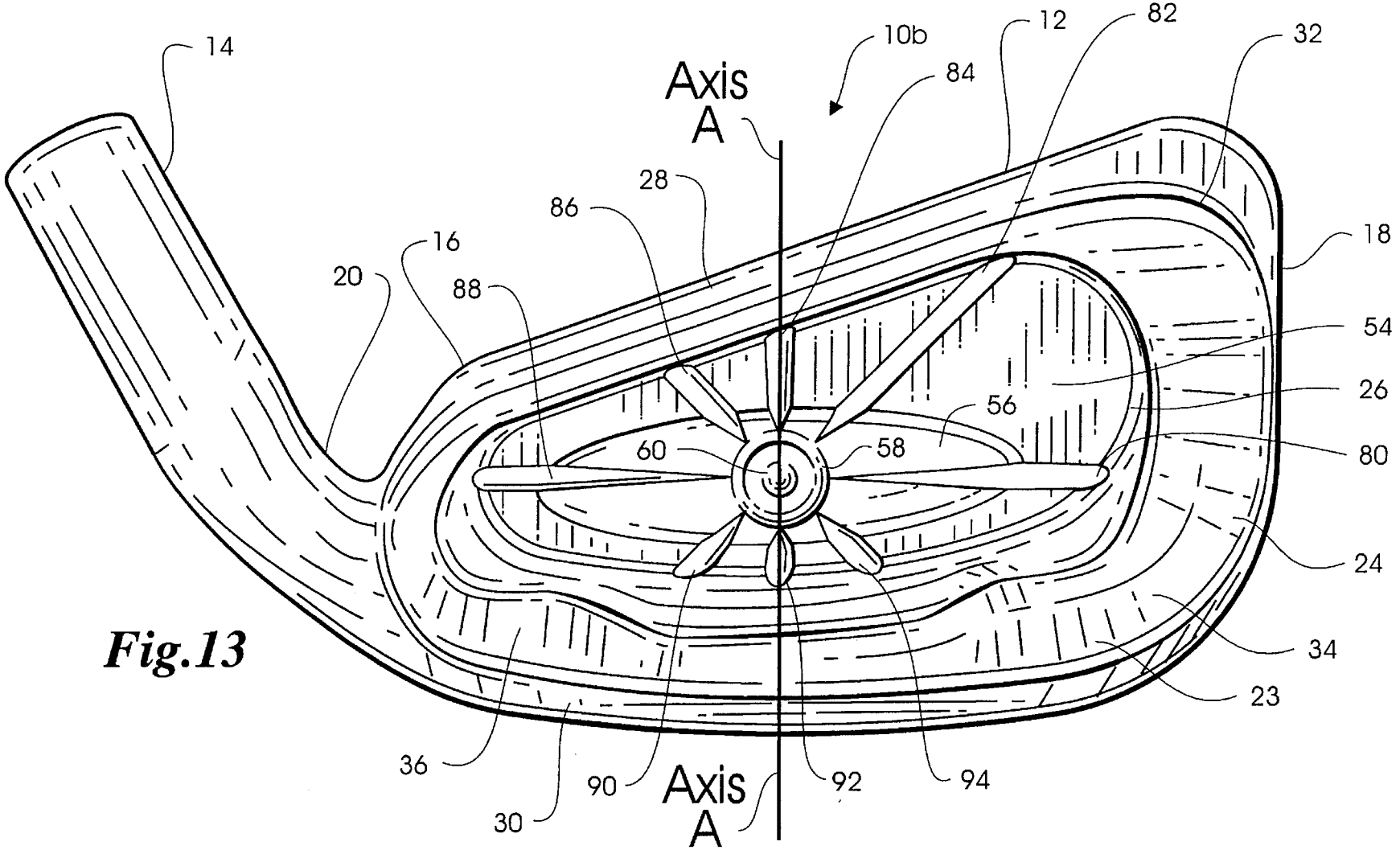

Referring to FIGS. 12 and 13, golf club heads according to alternative embodiments of the present invention are designated 10*a* and 10*b* with certain features as described in reference to the golf club head 10 shown in FIGS. 1–11. For example, the club heads 10*a* and 10*b* include a body 12, a hosel 14, a heel end 16, a toe end 18, a perimeter weighting element 24, a cavity 26, a top rail 28, a sole 30, an upper toe weight 32, a lower toe weight 34, and a lower heel weight 36.

In the club head 10*a* shown in FIG. 12, four radially extending ribs 72, 74, 76 and 78 are disposed in the cavity 26. Each of the ribs 72–78 extends from an inner end that is proximate the ring 58 to an outer end that merges with the perimeter weighting element 24. The rib 72 extends toward the toe end 18 of the body 12, the rib 74 extends toward the top rail 28, the rib 76 extends toward the heel end 16 of the body 12, and the rib 78 extends toward the sole 30. The ribs 72–78 are spaced 90 degrees apart with the ribs 74 and 78 arranged parallel the vertical axis A of the body 12.

In the club head 10*b* shown in FIG. 13, eight radially extending ribs 80, 82, 84, 86, 88, 90, 92 and 94 are disposed in the cavity 26. Each of the ribs 80–94 extends from an inner end that is proximate the ring 58 to an outer end that merges with the perimeter weighting element 24. The rib 80 extends toward the toe end 18 of the body 12, the ribs 82, 84, 86 extend toward the top rail 28, the rib 88 extends toward the heel end 16 of the body 12, and the ribs 90, 92, 94 extend toward the sole 30. The ribs 80–94 are spaced 45 degrees apart with the ribs 84 and 92 arranged parallel to the vertical axis A of the body 12.

If the front face 22 of the club head 10 impacts a golf ball at the center of gravity of the body 12 (i.e. near the projection 60), no undesirable vibrations are produced. However, if the front face 22 impacts a golf ball near the body heel end 16 or the body toe end 18, undesirable vibrations are eliminated by the ribs 62–70 and by the geometric region 56 and the ring 58. Other vibrations are attenuated by the ribs 62–70, the geometric region 56 and the ring 58. The ribs 62–70 account for about 85% of the total vibration elimination and attenuation while the geometric region 56 and the ring 58 account for about 15% of the vibration control. The ribs 62–70, the geometric region 56, the ring 58, and the projection 60 comprise means for tuning the club head 10 and for controlling vibration in the club head 10. Although the tuning and vibration control means has been described in reference to an iron-type club head such as the club head 10, it may also be used in wood-type club heads and putters.

In the present invention, vibration elimination refers to reduction of vibrations to a level where they are not perceptible, and vibration attentuation refers to reduction of vibrations to a lower level where they may still be perceptible.

Alternatively, the geometric region 56 may take the form of shapes other than an ellipse such as a diamond, a cloverleaf, a hexagon or a circle. Also, the ribs 62–70, 72–78 and 80–94 may be connected to the perimeter weighting element 24 by mechanical means rather than being integrally formed with the perimeter weighting element 24.

What is claimed is:

1. A golf club head comprising:

a body having a heel end, a toe end, a front face arranged for impact with a golf ball, a back face disposed rearwardly of said front face, and a perimeter weighting element protruding rearwardly away from said front face defining a cavity in said back face, said cavity having a bottom surface;

said perimeter weighting element including a top rail and a sole, said top rail extending between said body heel and toe ends along an upper portion of said body, and said sole extending between said body heel and toe ends along a lower portion of said body;

a plurality of ribs disposed in said cavity for eliminating undesirable vibrations in the club head caused when said front face impacts a golf ball and for attenuating other vibrations in the club head, each of said ribs having an outer end that merges with said perimeter weighting element;

a geometric region formed in said bottom surface of said cavity for assisting said plurality of ribs in eliminating said undesirable vibrations and in attenuating said other vibrations, said body having a center of gravity located within said geometric region; and a ring formed integrally with and rising above said geometric region, said ring encircling said center of gravity.

2. The golf club head of claim 1, wherein each of said ribs extends generally radially relative to said cavity from an inner end to said outer end thereof.

3. The golf club head of claim 2, wherein said plurality of ribs is comprised of five ribs, one of said ribs extends toward said toe end of said body, two of said ribs extend toward said top rail, and two of said ribs extend toward said sole.

4. The golf club head of claim 3, wherein one of said two ribs that extend toward said top rail is parallel to a vertical axis through said body.

5. The golf club head of claim 2, wherein said plurality of ribs is comprised of four ribs, one of said ribs extends toward said toe end of said body, one of said ribs extends toward said top rail, one of said ribs extends toward said heel end of said body, and one of said ribs extends toward said sole.

6. The golf club head of claim 5, wherein said one rib that extends toward said top rail and said one rib that extends toward said sole both are parallel to a vertical axis through said body.

7. The golf club head of claim 2, wherein said plurality of ribs is comprised of eight ribs, one of said ribs extends toward said toe end of said body, three of said ribs extend toward said top rail, one of said ribs extends toward said heel end of said body, and three of said ribs extend toward said sole.

8. The golf club head of claim 7, wherein one of the three ribs that extend toward said top rail and one of the three ribs that extend toward said sole both are parallel to a vertical axis through said body.

9. The golf club head of claim 1, wherein said perimeter weighting element comprises an upper toe weight adjacent a toe end of said top rail, a lower toe weight adjacent a toe end of said sole, and a lower heel weight adjacent a heel end of said sole.

10. The golf club head of claim 1, wherein each of said ribs has a generally arch-shaped cross-section.

11. The golf club head of claim 1, wherein said body has a center of gravity located within said geometric region.

12. The golf club head of claim 1, further comprising a projection formed integrally with and rising above said geometric region, said projection being encircled by said ring.

13. The golf club head of claim 12, wherein said plurality of ribs, said geometric region, said ring, and said projection comprise means for tuning the club head and for controlling vibration in the club head.

14. The golf club head of claim 1, wherein said geometric region is an elliptically shaped region.

15. The golf club head of claim 1, further comprising a hosel adjacent said heel end of said body.

16. A golf club head comprising:

a body having a heel end, a toe end, a front face arranged for impact with a golf ball, a back face disposed rearwardly of said front face, and a perimeter weighting element protruding rearwardly away from said front face defining a cavity in said back face, said cavity having a bottom surface;

said perimeter weighting element including a top rail and a sole, said top rail extending between said body heel and toe ends along an upper portion of said body, and said sole extending between said body heel and toe ends along a lower portion of said body;

means for tuning the club head and for controlling vibration in the club head, said tuning and vibration controlling means including a plurality of ribs disposed in said cavity and a geometric region formed in said bottom surface of said cavity for eliminating undesirable vibrations in the club head caused when said front face impacts a golf ball and for attenuating other vibrations in the club head; and said tuning and vibration controlling means further including a ring and a projection formed on said geometric region, and wherein said ring encircles said projection.

* * * * *